US010358750B2

(12) United States Patent
Ninomiya et al.

(10) Patent No.: US 10,358,750 B2
(45) Date of Patent: Jul. 23, 2019

(54) WEAR-RESISTANT MULTILAYER FABRICS

(71) Applicant: Toray Industries, Inc., Tokyo (JP)

(72) Inventors: Yuki Ninomiya, Otsu (JP); Hiroshi Tsuchikura, Otsu (JP); Koji Sugano, Otsu (JP)

(73) Assignee: Toray Industries, Inc. (JP)

( * ) Notice: Subject to any disclaimer, the term of this patent is extended or adjusted under 35 U.S.C. 154(b) by 521 days.

(21) Appl. No.: 14/906,739

(22) PCT Filed: Jul. 10, 2014

(86) PCT No.: PCT/JP2014/068404
§ 371 (c)(1),
(2) Date: Jan. 21, 2016

(87) PCT Pub. No.: WO2015/012114
PCT Pub. Date: Jan. 29, 2015

(65) Prior Publication Data

US 2016/0160407 A1 Jun. 9, 2016

(30) Foreign Application Priority Data

Jul. 25, 2013 (JP) ..... 2013-154288

(51) Int. Cl.
*D03D 15/10* (2006.01)
*D03D 1/00* (2006.01)
*D03D 11/00* (2006.01)

(52) U.S. Cl.
CPC ..... *D03D 15/10* (2013.01); *D03D 1/0041* (2013.01); *D03D 11/00* (2013.01)

(58) Field of Classification Search
CPC ..... D03D 15/10; D03D 1/0041; D03D 11/00
See application file for complete search history.

(56) References Cited

U.S. PATENT DOCUMENTS

| | | | |
|---|---|---|---|
| 5,709,944 A | 1/1998 | Kokumai et al. | |
| 6,365,556 B1 * | 4/2002 | Drew | C10M 149/12 384/299 |
| 2007/0178792 A1 | 8/2007 | Yoshida et al. | |
| 2010/0229998 A1 | 9/2010 | Ruan | |
| 2013/0251422 A1 * | 9/2013 | Iwaya | G03G 15/2053 399/329 |

FOREIGN PATENT DOCUMENTS

| | | |
|---|---|---|
| CN | 101638824 | 2/2010 |
| CN | 201793854 | 4/2011 |
| CN | 202965370 | 6/2013 |
| DE | 2436922 | 2/1976 |
| EP | 2 484 713 | 8/2012 |
| GB | 837749 | 6/1960 |
| GB | 2478855 | 9/2011 |
| JP | 61-114123 | 7/1986 |
| JP | 62-79112 | 4/1987 |
| JP | 1-139839 | 6/1989 |
| JP | 1-98921 | 7/1989 |
| JP | 5-509116 | 12/1993 |
| JP | 2005-220486 | 8/2005 |
| JP | 2007-232211 | 9/2007 |
| JP | 2008-45722 | 2/2008 |
| JP | 2008-150724 | 7/2008 |
| JP | 2009-35827 | 2/2009 |
| JP | 2011-42413 | 3/2011 |
| JP | 2011-190561 | 9/2011 |
| JP | 2012-251616 | 12/2012 |
| JP | 2013-83022 | 5/2013 |
| WO | 92/00343 | 1/1992 |
| WO | 93/16126 | 8/1993 |

OTHER PUBLICATIONS

Supplementary European Search Report dated Feb. 28, 2017, of corresponding European Application No. 14830291.2.

* cited by examiner

*Primary Examiner* — Cephia D Toomer
(74) *Attorney, Agent, or Firm* — DLA Piper LLP (US)

(57) ABSTRACT

A wear-resistant cloth has high wear resistance and is capable of exerting a long-term sliding property even under high-load environment as compared with conventional cloths. A wear-resistant multilayer fabric includes a sliding fabric and a base fabric. The sliding fabric includes polytetrafluoroethylene fibers A, the base fabric includes fibers B having creep ratio in a standard state and under 20% load of breaking strength, the creep ratio being lower than creep ratio of the polytetrafluoroethylene fibers, and the sliding fabric and the base fabric have mutual warps and/or wefts that are mutually entangled for bonding.

17 Claims, No Drawings

WEAR-RESISTANT MULTILAYER FABRICS

TECHNICAL FIELD

This disclosure relates to sliding multilayer fabrics having wear resistance.

BACKGROUND

Conventionally, fluorine resin has been used in the form of lamination or coating on the surface layer of a sliding member due to its low coefficient of friction. When fluorine resin is laminated or coated, however, a fluorine resin film is thin and easy to peel off because of its non-adhesion property and therefore laminating or coating has to be repeated to keep the long-term sliding property. To solve such a drawback, a sliding member has been developed, including fluorine resin in the form of fibers arranged as a woven or knitted fabric or a non-woven fabric on the surface of the sliding member to improve its friction durability, which is then made into a composite member with a woven or knitted fabric of an easily-adhering nature with other materials for firmer adhesion.

For example, JP H01-98921 U discloses a technique for a bearing structure made up of a supporter and a sliding part, which is made by coating the surface of the sliding part with a fiber cloth having PTFE-based fibers with single fiber fineness of 3.5 d or less at least at the surface of the bearing structure so that the bearing structure has an excellent easy sliding property.

JP 2008-150724 A discloses a multilayer structured cloth to reduce friction of vibration-absorbing rubber in a stabilizer bar of an automobile, including fluorine-based fibers on one surface and thermal adhesiveness fibers on the other surface to improve adhesiveness between the cloth and the sliding face of the vibration-absorbing rubber. JP 2009-35827 A discloses a technique for a cloth including fluorine-based fibers on one surface and dipped yarns prepared by coating fibers other than the fluorine-based fibers with resin beforehand to improve adhesiveness with rubber.

JP 2011-42413 A discloses a moving handrail of a conveyor, including a resin body part having a C-letter shape in cross section and is endless, and canvas disposed along the longitudinal direction of the resin body part and on an inside of the resin body part, and this canvas includes a base cloth disposed at the resin body part and a fluorine-fiber sliding cloth disposed on the base cloth to cover the surface of the base cloth partially, the fluorine-fiber sliding cloth having friction characteristics lower than those of the base cloth.

JP 2008-45722 A discloses a base isolating device including a lower shoe having a lower load-receiving face of a circular arc concave shape in cross section and an upper shoe having an upper load-receiving face of a circular arc concave shape in cross section, and a sliding body interposed between the lower load-receiving face of the lower shoe and the upper load-receiving face of the upper shoe and having a face at each of a top face and a bottom face thereof of a circular arc convex shape in cross section that comes into face-contact with each of the upper load-receiving face and the lower load-receiving face. In this base isolating device, the sliding body includes: a base made up of the lamination of thermosetting synthetic resin that is reinforced with fiber woven cloth, and a composite woven cloth sheet including a composite woven cloth made up of a woven cloth made of tetrafluoroethylene resin fibers and a woven cloth of organic fibers mutually overlapped and sewn with yarns made of fluorine resin for integration and thermosetting synthetic resin applied to the composite woven cloth for impregnation. On the organic fiber woven cloth side of the composite woven cloth sheet, surface-layer members joined integrally with the upper face and the lower face of the base, at least one concave formed on the base and these surface-layer members to be open at the surface of the surface-layer members serving as the cross-sectional circular arc convex face of the sliding body and to extend to a part of the base, and solid lubricant charged and held in a part surrounded with the surface-layer members and a part surrounded with the base continuous to the part of the concave are included.

However, the fiber cloth described in JP '921 as stated above is a cloth made up of yarns obtained by mix-spinning, intertwisting or twisting PTFE-based fibers and other fibers, a pile cloth including a typical synthetic fiber cloth as a base cloth and PTFE-based fibers as piles, or a cloth prepared by electrically flocking of the base cloth. In the cloth made up of yarns obtained by mix-spinning, intertwisting or twisting PTFE-based fibers and other fibers as stated above, fluorine fibers worn down are accumulated at gaps between fibers. The space for the accumulation, however, is small, so that the worn-down fluorine fibers will be discharged to the outside of the system. It thus is difficult to greatly improve durability. In the latter clothes including fluorine fibers at the surface layer as piles or prepared by flocking, confinement of fluorine fibers is loose, and the cloth will be easily worn.

When the cloth specifically described in JP '724 and JP '827 is used for a sliding purpose under high-load environment, fluorine fibers move easily, and damage to the fluorine fibers increases with an increase in the sliding distance so that the coefficient of friction increases or the durability decreases easily, and the durability will be degraded with an increase in load applied.

The technique described in JP '413 is to lengthen the life of a conveyor by decreasing friction during movement, and fix the canvas on the inside of the man conveyor and the sliding cloth easily and reliably while assuming sliding under low load applied to the conveyor. The durability thereof becomes extremely low when high load is applied. In the structure described in JP 722, sewing with the woven cloth made of organic fibers for integration is performed to improve adhesiveness of the lamination of thermosetting synthetic resin reinforced with fiber woven cloth as the base and the tetrafluoroethylene resin fibers. Thus, the manufacturing steps are complicated.

It could therefore be helpful to provide a wear-resistant cloth having high wear resistance and capable of exerting a long-term sliding property even under high-load environment as compared to conventional cloths.

SUMMARY

We thus provide:

(1) A wear-resistant multilayer fabric that is a multilayer fabric including a sliding fabric and a base fabric, wherein the sliding fabric includes polytetrafluoroethylene (PTFE) fibers A, the base fabric includes fibers B having creep ratio in a standard state and under 20% load of breaking strength, the creep ratio being lower than creep ratio of the PTFE fibers, and the sliding fabric and the base fabric have mutual warps and/or wefts that are mutually entangled for bonding.

(2) The wear-resistant multilayer fabric according to (1) that is a warp/weft multilayer fabric including the sliding fabric and the base fabric.

(3) The wear-resistant multilayer fabric according to (1) or (2), wherein the fibers B making up the base fabric have a tensile strength higher than a tensile strength of the PTFE fibers A making up the sliding fabric.

(4) The wear-resistant multilayer fabric according to any one of (1) to (3), wherein a ratio of the PTFE fibers A that are observed on a surface of the sliding fabric is 80% or more.

(5) The wear-resistant multilayer fabric according to any one of (1) to (4), wherein the fibers B include one or more fibers selected from poly-paraphenylene terephthalamide, polymetaphenylene isophthalamide, glass, carbon, polyparaphenylene benzobisoxazole (PBO) and polyphenylene sulfide (PPS).

(6) The wear-resistant multilayer fabric according to (5), wherein the fibers B include polyphenylene sulfide fibers.

(7) The wear-resistant multilayer fabric according to any one of (1) to (6), wherein the PTFE fibers A have creep ratio in a standard state and under 20% load of breaking strength that is 6% or less.

(8) The wear-resistant multilayer fabric according to any one of (1) to (7), wherein the base fabric is a plain weave fabric.

(9) The wear-resistant multilayer fabric according to any one of (1) to (8), wherein the sliding fabric is a plain weave fabric.

(10) The wear-resistant multilayer fabric according to any one of (1) to (9), wherein frequency of entangled bonding of the sliding fabric and the base fabric is 0.1 or more and 0.6 or less.

(11) The wear-resistant multilayer fabric according to any one of (1) to (10), wherein the base fabric is impregnated with resin.

(12) The wear-resistant multilayer fabric according to any one of (1) to (11) that is used under high load of 10 MPa or more and 400 MPa or less.

A wear-resistant cloth having high wear resistance and capable of exerting a long-term sliding property even under high-load environment as compared to conventional cloths can be provided.

DETAILED DESCRIPTION

Our wear-resistant cloth may be a multilayer fabric including a sliding fabric and a base fabric, and the sliding fabric includes PTFE fibers A and the base fabric includes fibers B having creep ratio in a standard state and under 20% load of breaking strength, the creep ratio being lower than creep ratio of the PTFE fibers, and the sliding fabric and the base fabric are required to have mutual warps and/or wefts mutually entangled for bonding.

Polytetrafluoroethylene fibers are used as the PTFE fibers A enabling low-friction sliding. Examples of the polytetrafluoroethylene fibers include homopolymer of tetrafluoroethylene or copolymer in which 90 mol % or more of the entire, preferably 95 mol % or more of the entire is tetrafluoroethylene. More tetrafluoroethylene units contained are preferable in terms of the sliding characteristics, and homopolymer is more preferable. Examples of monomer that can be copolymerized with the tetrafluoroethylene as stated above include, but not limited to, vinyl fluoride compounds such as trifluoroethylene, trifluorochloroethylene, tetrafluoropropylene and hexafluoropropylene as well as vinyl compounds such as propylene, ethylene, isobutylene, styrene and acrylonitrile. Among these monomers, a vinyl fluoride compound, especially a compound with higher fluorine content is preferable in terms of the friction characteristics of the fibers.

PTFE fibers are a soft material and exhibit excellent wear resistance during sliding under low load because of their low frictional sliding property, but tend to be easily worn down during sliding under high load. However, since our fabric is a multilayer fabric with a specific base fabric, the fabric as a whole does not generate breakage due to friction even when PTFE is worn down during sliding under high load. Thus, a wear-resistant cloth capable of exerting long-term sliding characteristics can be obtained. That is, our multilayer fabric allows PTFE worn down due to sliding under high load to be received at the entangled bonding points between the sliding fabric and the base fabric or on the sliding face-side of the base fabric so that a part of PTFE is applied to the entangled bonding points or the sliding fabric-side surface of the base fabric for coating, and the remaining PTFE is accumulated at uneven parts of the base fabric. Therefore even when the multilayer fabric as a whole is worn down, the surface of the base fabric will be coated with the PTFE accumulated at the uneven parts of the base fabric so that the surface of the cloth can remain in a state coated with PTFE, and can keep the sliding property for a long term.

The PTFE fibers can have any form of monofilament made up of one filament and multifilament made up of a plurality of filaments.

Fibers including the monofilament or the multifilament making up the PTFE fibers have total fineness of preferably 50 to 2,000 dtex and more preferably 100 to 1,000 dtex. When the total fineness of fibers making up the cloth is 50 dtex or more, the strength of the fibers is large, and breakage of yarns during weaving can be reduced, whereby the process passableness can be improved. When it is 2,000 dtex or less, this means less unevenness at the surface of the cloth and it does not influence the sliding property. Rigidity of the cloth does not become too high or the flexibility is not degraded and the cloth can be easily fitted along the shape of a face in use.

The sliding fabric may include fibers prepared by twisting PTFE fibers with other fibers or include spun yarns made of PTFE fibers only or mixed with other fibers. Higher content of PTFE fibers is preferable in terms of the sliding characteristics.

The ratio of PTFE fibers in the spun yarns including the mixture of PTFE fibers and other fibers as stated above is 50 weight % or more in the spun yarns. When the ratio of PTFE fibers is 50 weight % or more, deterioration of the coefficient of friction can be prevented.

For a more stable sliding property, the aforementioned ratio of PTFE fibers observed on the surface of the sliding fabric is preferably 80% or more. When the ratio is 80% or more, fluctuation in the coefficient of friction can be decreased, uniformity of the sliding direction can be made stable, and the directional property in sliding can be made small. The aforementioned ratio of PTFE fibers is a value obtained by the method described later.

The base fabric making up the wear-resistant multilayer fabric includes fibers B having a creep ratio in a standard state and under 20% load of breaking strength lower than the creep ratio of the PTFE fibers. The standard state herein refers to 20° C. and relative humidity of 65% RH.

If the creep ratio of the fibers B making up the base fabric is higher than that of the PTFE fibers in the standard state and under 20% load of breaking strength, then the base fabric becomes deformed easily. If the base fabric is deformed, the cloth will have difficulty in receiving worn-down PTFE, or the base fabric easily becomes elongated during sliding, which leads to friction with the sliding fabric and generates friction not only at the sliding face but also at the interface of the clothes, and so degrades the durability. The aforementioned creep ratio is a value obtained by the method described later.

To suppress deformation or elongation of the base fabric as stated above and to improve wear-resistance, the fibers B making up the base fabric preferably have a tensile strength higher than a tensile strength of the PTFE fibers making up the sliding fabric.

When fibers making up the base fabric have a tensile strength higher than a tensile strength of the PTFE fibers, the base fabric becomes firm, the ability to receive worn-down PTFE can be improved and durability can be improved. The tensile strength of fibers making up the base fabric is preferably 1.2 times or more of the tensile strength of the PTFE fibers to confine the PTFE fibers and receive worn-down PTFE fibers, and 1.5 times or more is more preferable. Although the upper limit is not especially limited, 20 times or less is preferable because such a range can facilitate adjustment of the tensile balance for entangling, and 15 times or less is more preferable.

To suppress deformation or elongation of the fabric structure, the degree of packing (new tightness factor) of the base fabric that is the ratio of the area of yarns to the cloth is preferably 60% or more and 100% or less, more preferably 65% or more and 100% or less. When the degree of packing of the base fabric is 60% or more, flowing-out of the worn-down PTFE fibers from the system can be suppressed and wear-resistance can be improved. 100% or less is preferable in terms of weaving properties.

The fibers B preferably include one or more fibers selected from poly-paraphenylene terephthalamide, polymetaphenylene isophthalamide, glass, carbon, poly-paraphenylene benzobisoxazole (PBO) and polyphenylene sulfide (PPS), and have creep ratio in the standard state (20° C.×65% RH) and under 20% load of breaking strength that is lower than creep ratio of PTFE fibers. Among these fibers, PPS fibers are preferable because they have durability even under severe environment such as heat resistance, chemical resistance, and hydrolysis resistance.

The PTFE fibers may be prepared by wet spinning in which fine powder is mixed in cellulose-based fiber solution, followed by spinning and thereafter cellulose is sublimated, by a slit method in which fibers in a film is split, or by a skive method in which fibers in a film are opened through abrasion, and PTFE resin having a degree of polymerization suitable for the manufacturing method may be used.

In general, creep characteristics change with the manufacturing method of fibers or the degree of polymerization of resin used, and PTFE fibers used in the wear-resistant fabric have a creep ratio in the standard state and under 20% load of breaking strength of 6% or less. When the creep ratio in the standard state and under 20% load of breaking strength is 6% or less, elongation of PTFE fibers during sliding can be suppressed and durability tends to be improved during temperature rise or under high load. The lower limit of the creep ratio of PTFE fibers is preferably 0.5% or more in terms of weaving properties.

The fibers B making up the base fabric have creep ratio in the standard state and under 20% load of breaking strength lower than creep ratio of PTFE fibers as stated above and, to give more noticeable effect to keep the sliding property for a long term, the creep ratio is preferably 3% or less, and 2% or less more preferably. Although the creep ratio of thermoplastic fibers can be changed by the conditions such as draw ratio, thermosetting temperature or time, the creep ratio becomes high in undrawn yarns or semidrawn yarns, for example, and caution is required for use.

A multilayer fabric that is the wear-resistant fabric refers to one fabric having a plurality of layers in which two or more layered fabric includes a sliding fabric and a base fabric that are bonded so that mutual warps and/or wefts and mutual wefts and/or warps are entangled. Among them, a warp/weft multilayer fabric including a sliding fabric and a base fabric is preferable. A warp/weft multilayer fabric refers to a fabric, for example, including a plurality of fabrics such as a sliding fabric and a base fabric, each fabric having their independent warps and wefts in which mutual warps and/or wefts are entangled for bonding with predetermined frequency. Although a twill weave fabric or satin prepared by weaving different yarns as warps and wefts has a two-layered structure apparently, they are not a multilayer fabric because they do not have a plurality of fabrics. Further, although a weft multilayer fabric or the like prepared by using common warps and two or more types of wefts and weaving these yarns so that two or more layers of fabrics are entangled for bonding is a multilayer fabric, it is not a warp/weft multilayer fabric because each of the plurality of fabrics does not have their independent warps and wefts. Since a warp/weft multilayer fabric does not include common fibers between the sliding fabric and the base fabric, a type of fibers having a high sliding property can be selected for the sliding fabric and a type of fibers suitable for receiving worn-down PTFE fibers may be selected for the base fabric. Among multilayer fabrics, a two-layered fabric including a sliding fabric and a base fabric is preferable in terms of the ability of holding worn-down PTFE fibers due to wearing at a place close to the friction surface and in terms of weaving properties.

For the construction of the base fabric in the wear-resistant fabric, plain weave, twill weave, satin or other constructions can be used, and plain weave is preferable for the base fabric because unevenness receiving worn-down PTFEs is distributed more uniformly and a fabric of higher smoothness or the like is preferable to increase adhesiveness with the mating material.

For the sliding fabric also, plain weave, twill weave, satin or other constructions can be used, and plain weave is preferable because it is more uniform in the direction of sliding, and the structure including plain weave as the base fabric and plain weave as the sliding fabric is more preferable.

The base fabric and the sliding fabric have the mutual warps and/or wefts mutually entangled for bonding, and the frequency of this entangling for bonding is preferably 0.1 or more and 0.6 or less, and 0.2 or more and 0.4 or less more preferably. When the frequency of the entangling for bonding is 0.1 or more, joining between the base fabric and the sliding fabric becomes firmer and so the base fabric and the sliding fabric are less displaced from each other and wearing-down due to friction between the base fabric and the sliding fabric can be prevented. When the frequency is 0.6 or less, gaps between yarns decrease due to increased entangling, which can prevent the difficulty in increasing the density of yarns that is representation of the number of yarns per inch (2.54 cm), and the density balance between warps/wefts can be adjusted.

For increased durability, the base fabric may be impregnated with resin for use. Herein, the resin for impregnation may be thermosetting resin or thermoplastic resin. Examples of the thermosetting resin include, but are not limited to, phenol resin, melamine resin, urea resin, unsaturated polyester resin, epoxy resin, polyurethane resin, diallyl phthalate resin, silicon resin, polyimide resin, vinylester resin and their modified resins, and examples of the thermoplastic resin include, but are not limited to, vinyl chloride resin, polystyrene, ABS resin, polyethylene, polypropylene, fluorine resin, polyamide resin, polyacetal resin, polycarbonate resin, polyester and polyamide as well as synthetic rubber or elastomer such as thermoplastic polyurethane, butadiene rubber, nitrile rubber, neoprene, polyester or the like, which can be used preferably. Among them, resin mainly containing phenol resin and polyvinylbutyral resin, unsaturated polyester resin, vinylester resin, polyolefin-based resins such as polyethylene or polypropylene, and polyester resin are preferably used in terms of impact resistance, dimension stability, strength, cost and the like. Such thermosetting resin or thermoplastic resin may contain various additives usually used for industrial purposes or use to improve productivity at the manufacturing steps or the processing steps or to improve their characteristics. For example, they may contain additives such as modifier, plasticizer, filler, mold-releasing agent, colorant, and diluent. Mainly contained in this case refers to a component of the largest ratio by weight among the components other than solvent, and in resin mainly containing phenol resin and polyvinylbutyral resin, this means that the ratios by weight of these two types of resin are the largest and the second largest (random order).

For a generally used method of impregnating the base fabric with resin, when thermosetting resin is used, the thermosetting resin may be dissolved into solvent to prepare a varnish, which then may be coated on the base fabric side for impregnation by knife coat processing, roll coat processing, comma coat processing, gravure coat processing or the like. When thermoplastic resin is used, melting extrusion lamination or the like is typically used.

The wear-resistant multilayer fabric may include fluorine-based lubricant added as needed.

The thus obtained wear-resistant multilayer fabric has a structure in which the base fabric confines PTFE fibers of the sliding fabric firmly, and the worn-down PTFE fibers can be accumulated in the multilayer fabric, and therefore the fabric can exert a long-term sliding property especially when it is used as the sliding member under high load as compared with the conventional ones. For instance, under the load of 10 MPa or more, especially even under environment of very high load of 10 MPa or more and 400 MPa or less, the fabric can be used preferably. The wear-resistant multilayer fabric can exert the effect of improving wear resistance that is more excellent than that of other conventional PTFE sliding cloths especially when it is used under high load of 10 MPa or higher. When the load is set at 400 MPa or less, breakage of PTFE fibers due to cold flow at the compression under load can be prevented.

EXAMPLES

The following describes examples of our fabrics as well as comparative examples.

Various characteristics used in the examples are measured as follows.

(1) Creep Ratio in a Standard State (20° C.×65% RH) and Under 20% Load of the Breaking Strength (Creep Ratio)

For yarns obtained by unweaving a fabric, its breaking strength is measured in the standard state according to JIS L1013:2010 (test method for man-made fiber filament yarns). Meanwhile one end of the fibers in the standard state is fixed, and load is suspended from the other end so that the tension applied to the fibers becomes 20% of this breaking strength, and then when one hour has passed, the length (Lc1) is measured. The creep ratio is determined by the following expression about the elongation with reference to the initial length (Lc0). The initial length is the length obtained when initial load of (5.88 mN×reading in tex) is applied.

$$\text{Creep ratio (\%)}=[(Lc1-Lc0)/Lc0]\times 100$$

(2) Tensile Strength (Breaking Strength)

For yarns obtained by unweaving a fabric, its breaking strength is measured according to JIS L1013:2010 (test method for man-made fiber filament yarns).

(3) Ratio of PTFE Fibers Observed on the Surface of a Sliding Fabric (Fluorine Fiber Ratio on Sliding Face)

Based on a photo of the surface of a fabric on the sliding fabric side that is magnified by 30 times with a microscope VHX-2000 produced by Keyence Corporation, the ratio of surface area between fibers including fluorine fibers and others is calculated.

(4) Frequency of Entangled Bonding of a Sliding Fabric and a Base Fabric (Entangling Frequency) (when Warps are Entangling Yarns, and if Wefts are Entangling Yarns, Read as in ( ))

For a multilayer fabric of at least 1 cm square in size, the fabric is unwoven, and the average of the ratio of entangling of warps (wefts) of the sliding fabric and wefts (warps) of the base fabric with reference to the frequency of warps (wefts) of the sliding fabric passing through the base fabric, and the ratio of entangling of warps (wefts) of the basic fabric and wefts (warps) of the sliding fabric with reference to the frequency of warps (wefts) of the base fabric passing through the sliding fabric is found.

A=the frequency of entangling of warps (wefts) of the sliding fabric and wefts (warps) of the base fabric/the frequency of warps (wefts) of the sliding fabric passing through the base fabric B=the frequency of entangling of warps (wefts) of the basic fabric and wefts (warps) of the sliding fabric/the frequency of warps (wefts) of the base fabric passing through the sliding fabric The frequency ratio of entangled bonding of the sliding fabric and the base fabric=(A+B)/2

(5) Weaving Density

A sample is placed on a flat base according to JIS1096: 2010 (test method for woven or knitted cloth), and unnatural creases and tensions are removed therefrom. Then, the number of warps and wefts in 50 mm is counted at different parts, and their averages are calculated for unit length.

(6) Tribogear Dynamic Friction Coefficient

A cloth is fixed by a screw to a flat indenter (63 mm ×63 mm in area) at the moving speed of 100 mm/min and under the load of 1.0 kg using Tribogear (Type: HEIDON-14DR) that is a surface property tester produced by Shinto Scientific Co., Ltd., and the coefficient of friction between the sliding fabric face and a stainless-steel plate (mirror finished) is measured. The measurement is performed under a constant temperature and humidity environment (20±2° C., 60±5% RH) and for the lengthwise direction and the crosswise direction of the fabric.

(7) Ring Wear Test (Friction Wear Test 1 to 3)

According to JIS K7218:1986 (test method for sliding wear resistance of plastics) method A, a sample of a fabric of 30 mm in length and 30 mm in width is taken, which is placed on a POM resin plate with the same dimensions and of 2 mm in thickness and is fixed to a sample holder.

The mating material used is made of S45C, and has a hollow cylindrical shape of 25.6 mm in outer diameter, 20 mm in inner diameter and 15 mm in length. The surface of this is polished with sandpaper so that the roughness is 0.8 μmm±0.1 Ra, which is measured by a roughness tester (produced by Mitsutoyo Corporation, SJ-201).

As the ring wear tester, MODEL: EFM-III-EN produced by Orientec is used, and testing is performed while changing the friction load (MPa) and with the frictional speed of 10 mm/second to measure the sliding torque until the frictional sliding distance of 100 m. Then, the coefficient of friction at a stable part is calculated, and the surface state of the fabric sample after sliding is observed. A sample substantially without wearing at the PTFE part is rated as ◎, a sample with wearing but that has a stable coefficient of friction is rated as ○, a sample with wearing and an increased coefficient of friction is rated as Δ, and a sample where the fabric is broken is rated as x.

(8) Number of Twists

The number of twists is found as follows. A fabric is unwoven to be warps and wefts, a sample of each of which is attached to a twist counter according to JIS L1013:2010 (test method for man-made fiber filament yarns) while setting the length of the sample between grips at 50 cm and under the specified initial load. Then, the number of twists is measured, which is doubled to find the number of twists for 1 m.

(9) Hydrolysis Resistance

The degree of strength and elongation of a fabric is measured according to JIS1096:2010 (test method for woven or knitted cloth) using an autoclave and in the saturated water vapor at 160° C. for 24 hours, and the strength retention before and after the treatment is measured.

(10) Degree of Packing (New Tightness Factor)

The degree of packing of a cloth is the ratio of the area of the cloth actually covered by yarns that is represented by %, while considering the state where the cloth is filled with yarns without gaps theoretically as 100% when the cloth is projected onto a plane, which is basically described in Shokei Gakuin University in Japan, Journal No. 54, pp 139 to 147 (analysis of a fabric structure by new tightness factor).

For a base fabric, the ratio of the actual weaving density to the number of yarns when the fabric in unit length (cm) is filled with the yarns without gaps theoretically in a weave repeat as the maximum density of yarns is calculated, and the result is multiplied by 100 to be represented in percentage. For the calculation, the number of warps and wefts of a sliding fabric entangled in the base fabric is not counted.

The number of yarns with which the fabric in unit length (cm) is filled without gaps theoretically can be represented geometrically by Expression (1) while considering the interwoven state of warps and wefts of the fabric.

Geometrical Structure of a Fabric $$tm=e/\{(e-i)\pi d/4+2id\} \quad (1),$$

where e denotes the number of yarns in one weave repeat,
i denotes the number of interweaving in one weave repeat,
d denotes the diameter of yarns (cm),
tm denotes the theoretically maximum number of yarns in unit length (1 cm), and
e denotes the coefficient of i.

TABLE 1

| fabric construction name | values of e | values of i |
|---|---|---|
| plain weave | 2 | 2 |
| 1/2 twill weave | 3 | 2 |
| 2/2 twill weave | 4 | 2 |
| 3/1 twill weave | 4 | 2 |
| 3/3 twill weave | 6 | 2 |
| 4/4 twill weave | 8 | 2 |
| 5 harness 2 steps satin | 5 | 2 |

Journal No. 54, mentioned above, states that the diameter of yarns is calculated based on the thickness of fibers, the specific weight of fibers and the packing factor, and calculation of the packing factor requires the mass per unit area of the fabric and the thickness of the fabric. In a multilayer fabric, however, it is not possible to find correct mass per unit area and thickness of a base fabric alone, and so the diameter of yarns is found by Expression (2) while setting the packing factor at 1 (assuming that single yarns are mutually attached tightly without gaps).

$$d(\text{cm})=0.00357\times(\text{yarn thickness(tex)}/\phi\times\rho f)\hat{}(1/2) \quad (2),$$

where ϕ denotes the packing factor (=1), and
ρf denotes the specific weight of fibers.

New Tightness Factor (T) indicating the structural density ratio of a fabric is found by Expression (3).

$$T(\%)=[(ta1+ta2)/(tm1+tm2)]\times 100 \quad (3),$$

where ta1 denotes the number of warps actually occupying in unit length (1 cm),
ta2 denotes the number of wefts actually occupying in unit length (1 cm),
tm1 denotes the theoretically maximum number of warps in unit length (1 cm), and
tm2 denotes the theoretically maximum number of wefts in unit length (1 cm).

Example 1

PPS fibers were used as warps and wefts of base fabric fibers, where the PPS fibers had 220 dtex, 50 filaments, the number of twists of 300 t/m, and the creep ratio of 2.0%, and PTFE fibers were used as warps and wefts of a sliding fabric, where the PTFE fibers had 440 dtex, 60 filaments, and the number of twists of 300 t/m. Then, a two-layered plain weave fabric was manufactured using these yarns by a Rapier loom so that the weaving density was 70+70 warps/inch (2.54 cm) (sliding fabric warps+base fabric warps (warps/inch (2.54 cm), the same applies in the following) and 60+60 wefts/inch (2.54 cm) (sliding fabric wefts+base fabric wefts (wefts/inch (2.54 cm), the same applies in the following) and, so that for the entangling of the sliding fabric and the base fabric, frequency of bonding was 0.2 when warps of the sliding fabric and warps of the base fabric were entangling yarns. Then, refining was performed thereto in a refining tank at 80° C., and set at 200° C.

This fabric was unwoven, and the strength, the creep ratio and the number of twists of the warps and wefts were measured, and the fabric was evaluated by Tribogear and a friction wear tester or the like. Table 2 summarizes the results of evaluation.

Comparative Example 1

PTFE fibers were used as warps and wefts, where the PTFE fibers had 440 dtex, 60 filaments, the number of twists of 300 t/m, and the creep ratio of 4.5%, and a plain weave fabric was manufactured using these yarns so that the weaving density was 70 warps/inch (2.54 cm) and 60 wefts/inch (2.54 cm), to which refining and setting similar to Example 1 were performed. This fabric was unwoven and the strength, the creep ratio and the number of twists of the warps and wefts were measured, and the fabric was evaluated by Tribogear and a friction wear tester or the like. Table 2 summarizes the results of evaluation.

Comparative Example 2

A two-layered plain weave fabric was manufactured similarly to Example 1 except that Nylon 6 fibers were used as warps and wefts as base fabric fibers, where the Nylon 6 fibers had 220 dtex, 50 filaments, the number of twists of 500 t/m, and the creep ratio of 7.5%, to which refining and setting similar to Example 1 were performed. This fabric was evaluated by Tribogear and a friction wear tester or the like, and Table 2 summarizes the results of evaluation.

Example 2

A two-layered plain weave fabric was manufactured similarly to Example 1 except that poly-paraphenylene terephthalamide (registered trademark "Kevlar") fibers were used as warps and wefts as base fabric fibers, where these fibers had 220 dtex, 134 filaments, the number of twists of 300 t/m, and the creep ratio of 0.7%, to which refining and setting similar to Example 1 were performed. This fabric was unwoven and the strength, the creep ratio and the number of twists of the warps and wefts were measured, and the fabric was evaluated by Tribogear and a friction wear tester or the like. Table 2 summarizes the results of evaluation.

Examples 3 to 7

Fabrics were manufactured while changing the conditions of the base fabric and the sliding fabric variously as shown in Tables 2 and 3, to which refining and setting similar to Example 1 were performed. These fabrics were unwoven and the strength, the creep ratio and the number of twists of the warps and wefts were measured, and the fabrics were evaluated by Tribogear and a friction wear tester or the like. Tables 2 and 3 summarize the results of evaluation.

In this way, it was clarified that a wear-resistant multilayer fabric can have remarkably improved wear resistance under high load.

Comparative Example 3

PTFE fibers having 440 dtex, 60 filaments, the number of twists of 300 t/m, and the creep ratio of 4.5% and polyethylene terephthalate fibers having 560 dtex, 96 filaments, and the creep ratio of 2% and being twistless were used, and these fibers were knitted by a double raschel knitting machine so that the interknitting ratio was fluorine-based fibers:polyethylene terephthalate fibers=60:40, the number of courses: 29 courses/inch (2.54 cm) and the number of wales: 19 wales/inch (2.54 cm), to which refining and setting similar to Example 1 were performed. This knitted fabric was unknitted and the strength, the creep ratio and the number of twists of the yarns were measured, and the knitted fabric was evaluated by Tribogear and a friction wear tester or the like. Table 3 summarizes the results of evaluation.

TABLE 2

| | | | | Ex. 1 | Comp. Ex. 1 | Comp. Ex. 2 | Ex. 2 | Ex. 3 | Ex. 4 |
|---|---|---|---|---|---|---|---|---|---|
| sliding fabric | warps | | | PTFE 440T-60F | PTFE 440T-60F | PTFE 440T-60F | PTFE 440T-60F | PTFE 440T-60F | PTFE 440T-60F |
| | number of twists | | t/m | 300 | 300 | 300 | 300 | 300 | 300 |
| | creep ratio | | % | 4.5 | 4.5 | 4.5 | 4.5 | 7.6 | 4.5 |
| | breaking strength | | cN | 616.0 | 616.0 | 616.0 | 616.0 | 520.0 | 616.0 |
| | wefts | | | PTFE 440T-60F | PTFE 440T-60F | PTFE 440T-80F | PTFE 440T-60F | PTFE 440T-60F | PTFE 440T-60F |
| | number of twists | | t/m | 300 | 300 | 300 | 300 | 300 | 300 |
| | creep ratio | | % | 4.5 | 4.5 | 4.5 | 4.5 | 7.6 | 4.5 |
| | breaking strength | | cN | 616.0 | 616.0 | 616.0 | 616.0 | 520.0 | 616.0 |
| basic fabric | warps | | | PPS 220T-50F | — | nylon 220T-68F | para-alamide 220T-134F | PPS 220T-50F | PPS 220T-50F |
| | number of twists | | t/m | 300 | — | 500 | 300 | 300 | 300 |
| | creep ratio | | % | 2.0 | — | 7.5 | 0.7 | 2.0 | 2.0 |
| | breaking strength | | cN | 924 | — | 1408 | 4620 | 924 | 924 |
| | wefts | | | PPS 220T-50F | — | nylon 220T-68F | para-alamide 220T-134F | PPS 220T-50F | PPS 220T-50F |
| | number of twists | | t/m | 300 | — | 500 | 300 | 300 | 300 |
| | creep ratio | | % | 2.0 | — | 7.5 | 0.7 | 2.0 | 2.0 |
| | breaking strength | | cN | 924 | — | 1408 | 4620 | 924 | 924 |
| multilayer cloth | weaving construction | sliding member/base | | plane/plane | plane/plane | plane/plane | plane/plane | plane/plane | twill(2/1)/twill(2/1) |
| | weaving density | warps (sliding fabric warps + base fabric warps) | yarns/inch (2.54 cm) | 70 + 70 | 70 | 70 + 70 | 70 + 70 | 70 + 70 | 70 + 70 |
| | | wefts (sliding fabric warps + base fabric warps) | yarns/inch (2.54 cm) | 60 + 60 | 60 | 60 + 60 | 60 + 60 | 60 +6 0 | 80 + 80 |
| | entangling frequency | | | 0.20 | — | 0.20 | 0.20 | 0.20 | 0.20 |
| | ratio of flourine fibers on sliding face | | % | 95.0 | 100.0 | 95.0 | 93.0 | 95.0 | 95.0 |
| | new tightness factor of fabric base (degree of packing) | | % | 73.0 | 81.7 | 81.7 | 71.4 | 73.0 | 67.1 |
| | Tribogear dynamic friction | | warps | 0.051 | 0.050 | 0.050 | 0.046 | 0.051 | 0.051 |
| | coefficient | | wefts | 0.049 | 0.053 | 0.052 | 0.049 | 0.054 | 0.072 |
| friction wear test 1 | load | | MPa | 20 | 20 | 20 | 20 | 20 | 20 |
| | friction coefficient | | | 0.076 | 0.072 | 0.073 | 0.075 | 0.077 | 0.082 |
| | wearing-down state | | | ○ | X | X | ○ | Δ | ○ |
| friction wear test 2 | load | | MPa | 10 | 10 | 10 | 10 | 10 | 10 |
| | friction coefficient | | | 0.072 | 0.68 | 0.071 | 0.072 | 0.071 | 0.076 |
| | wearing-down state | | | ◎ | X | Δ | ○ | ○ | ◎ |
| friction wear test 3 | load | | MPa | 5 | 5 | 5 | 5 | 5 | 5 |
| | friction coefficient | | | 0.058 | 0.056 | 0.058 | 0.058 | 0.056 | 0.065 |
| | wearing-down state | | | ◎ | X | ○ | ◎ | ○ | ◎ |
| hydrolysis resistance | strength retention after 24-hour treatment in saturated water vapor at 160° C. | | % | 100 | 100 | 90 | 75 | 100 | 100 |

* in table T = dtex, F = filament

TABLE 3

| | | | | Ex. 5 | Ex. 6 | Ex. 7 | Comp. Ex. 3 |
|---|---|---|---|---|---|---|---|
| sliding fabric | warps | | | PTFE 440T-60F | PTFE 440T-60F | PTFE 440T-60F | PTFE 440T-60F |
| | number of twists | | t/m | 300 | 300 | 300 | |
| | creep ratio | | % | 7.6 | 4.5 | 4.5 | |
| | breaking strength | | cN | 520.0 | 616.0 | 616.0 | |
| | wefts | | | PTFE 220T-50F | PTFE 440T-60F | PTFE 440T-60F | |
| | number of twists | | t/m | 300 | 300 | 300 | |
| | creep ratio | | % | 2.0 | 4.5 | 4.5 | |
| | breaking strength | | cN | 924.0 | 616.0 | 616.0 | |
| basic fabric | warps | | | PPS 220T-50F | PPS 220T-50F | PPS 220T-50F | PET 560T-96F |
| | number of twists | | t/m | 300 | 300 | 300 | |
| | creep ratio | | % | 2.0 | 2.0 | 2.0 | |
| | breaking strength | | cN | 924 | 924 | 924 | |
| | wefts | | | PPS 220T-50F | PPS 220T-50F | PPS 220T-50F | |
| | number of twists | | t/m | 300 | 300 | 300 | |
| | creep ratio | | % | 2.0 | 2.0 | 2.0 | |
| | breaking strength | | cN | 924 | 924 | 924 | |
| multilayer cloth | weaving construction | sliding member/ base | | plane/plane | plane/plane | plane/plane | double raschel |
| | weaving density | warps (sliding fabric warps + base fabric warps) | yarns/inch (2.54 cm) | 70 + 70 | 70 + 70 | 70 + 70 | courses 29 |
| | | wefts (sliding fabric warps + base fabric warps) | yarns/inch (2.54 cm) | 60 + 60 | 60 + 60 | 50 + 50 | wales 19 |
| | entangling frequency | | | 0.20 | 0.50 | 1.00 | — |
| | ratio of flourine fibers on sliding face | | % | 50.0 | 88.0 | 85.0 | 75.0 |
| | new tightness factor of fabric base (degree of packing) | | % | 73.0 | 73.0 | 67.3 | — |
| | Tribogear dynamic friction coefficient | | warps | 0.062 | 0.053 | 0.053 | 0.120 |
| | | | wefts | 0.072 | 0.054 | 0.054 | 0.150 |
| friction wear test 1 | load | | MPa | 20 | 20 | 20 | 20 |
| | friction coefficient | | | 0.072-0.82 | 0.077 | 0.077 | 0.140 |
| | wearing-down state | | | Δ | ○ | Δ | ○ |
| friction wear test 2 | load | | MPa | 10 | 10 | 10 | 10 |
| | friction coefficient | | | 0.072 | 0.68 | 0.071 | 0.072 |
| | wearing-down state | | | ○ | ○ | ○ | Δ |
| friction wear test 3 | load | | MPa | 10 | 10 | 10 | 10 |
| | friction coefficient | | | 0.065-0.075 | 0.074 | 0.074 | 0.150 |
| | wearing-down state | | | ○ | ◎ | ◎ | X |
| hydrolysis resistance | strength retention after 24-hour treatment in saturated water vapor at 160° C. | | % | 100 | 100 | 100 | 10 |

* in table T = dtex, F = filament

The invention claimed is:

1. A wear-resistant multilayer fabric comprising a sliding fabric and a base fabric, wherein the sliding fabric comprises polytetrafluoroethylene fibers A, the base fabric comprises fibers B having a creep ratio in a standard state and under 20% load of breaking strength lower than a creep ratio of the polytetrafluoroethylene fibers, the sliding fabric and the base fabric have mutual warps and/or wefts that are mutually entangled for bonding, frequency of entangled bonding of the sliding fabric and the base fabric is 0.1 or more and 0.4 or less, the creep ratio is determined in a standard state, at 20° C. and relative humidity 65% RH, and under 20% load of the breaking strength, and is measured by a method in which, for yarns obtained by unweaving a fabric, the breaking strength is measured in the standard state according to JIS L1013:2010 (test method for man-made fiber filament yarns), one end of the fibers in the standard state is fixed, and load is suspended from another end so that tension applied to the fibers becomes 20% of the breaking strength, and when one hour has passed, a length (Lc1) is measured;

the creep ratio is determined by expression (1) about the elongation with reference to an initial length (Lc0), wherein the initial length is the length obtained when an initial load of (5.8 mN×reading in tex) is applied:

$$\text{creep ratio } (\%)=[(Lc1-Lc0)/Lc0]\times 100 \quad (1), \text{ and}$$

the frequency of entangled bonding of the sliding fabric and the base fabric is measured as follows:

for a multilayer fabric of at least 1 cm square in size, the fabric is unwoven, and an average of a ratio of entangling of warps and wefts of the sliding fabric and wefts and warps of the base fabric with reference to a frequency of warps and wefts of the sliding fabric passing through the base fabric, and the ratio of entangling of warps and wefts of the base fabric and wefts and warps of the sliding fabric with reference to the frequency of warps and wefts of the base fabric passing through the sliding fabric is found;

the frequency ratio of entangled bonding of the sliding fabric and the base fabric is calculated as (A+B)/2;

wherein A=the frequency of entangling of warps and wefts of the sliding fabric and wefts and warps of the base fabric and the frequency of warps and wefts of the sliding fabric passing through the base fabric, and B=the frequency of entangling of warps and wefts of the base fabric and wefts and warps of the sliding fabric and the frequency of warps and wefts of the base fabric passing through the sliding fabric.

2. The wear-resistant multilayer fabric according to claim 1, that is a warp and weft multilayer fabric including the sliding fabric and the base fabric.

3. The wear-resistant multilayer fabric according to claim 1, wherein the fibers B making up the base fabric have a tensile strength higher than a tensile strength of the polytetrafluoroethylene fibers A making up the sliding fabric;

the tensile strength is for yarns obtained by unweaving a fabric and being the breaking strength measured according to JIS L1013:2010 (test method for man-made fiber filament yarns).

4. The wear-resistant multilayer fabric according to claim 1, wherein a ratio of the polytetrafluoroethylene fibers A that are observed on a surface of the sliding fabric is 80% or more.

5. The wear-resistant multilayer fabric according to claim 1, wherein the fibers B include one or more fibers selected from poly-paraphenylene terephthalamide, polymetaphenylene isophthalamide, glass, carbon, polyparaphenylene benzobisoxazole (PBO) and polyphenylene sulfide (PPS).

6. The wear-resistant multilayer fabric according to claim 5, wherein the fibers B include polyphenylene sulfide fibers.

7. The wear-resistant multilayer fabric according to claim 1, wherein the polytetrafluoroethylene fibers A have creep ratio in a standard state and under 20% load of breaking strength that is 0.5% to 6%.

8. The wear-resistant multilayer fabric according to claim 1, wherein the base fabric is a plain weave fabric.

9. The wear-resistant multilayer fabric according to claim 1, wherein the sliding fabric is a plain weave fabric.

10. The wear-resistant multilayer fabric according to claim 1, wherein the base fabric is impregnated with resin.

11. The wear-resistant multilayer fabric according to claim 1 that can withstand a load of 10 MPa or more and 400 MPa or less.

12. The wear-resistant multilayer fabric according to claim 2, wherein the polytetrafluoroethylene fibers A have a creep ratio in a standard state and under 20% load of breaking strength that is 6% or less.

13. The wear-resistant multilayer fabric according to claim 2, wherein the base fabric is a plain weave fabric.

14. The wear-resistant multilayer fabric according to claim 2, wherein frequency of entangled bonding of the sliding fabric and the base fabric is 0.1 or more and 0.6 or less.

15. The wear-resistant multilayer fabric according to claim 2, wherein the fibers B include polyphenylene sulfide fibers.

16. The wear-resistant multilayer fabric according to claim 15, wherein the polytetrafluoroethylene fibers A have a creep ratio in a standard state and under 20% load of breaking strength that is 0.6% or less.

17. The wear-resistant multilayer fabric according to claim 15, wherein frequency of entangled bonding of the sliding fabric and the base fabric is 0.1 or more and 0.6 or less.

* * * * *